US007657407B2

(12) United States Patent
Logan

(10) Patent No.: US 7,657,407 B2
(45) Date of Patent: Feb. 2, 2010

(54) METHOD AND SYSTEM OF PLANNING HYDROCARBON EXTRACTION FROM A HYDROCARBON FORMATION

(75) Inventor: Richard B Logan, Anchorage, AK (US)

(73) Assignee: Landmark Graphics Corporation, Houston, TX (US)

( * ) Notice: Subject to any disclaimer, the term of this patent is extended or adjusted under 35 U.S.C. 154(b) by 563 days.

(21) Appl. No.: 11/464,551

(22) Filed: Aug. 15, 2006

(65) Prior Publication Data

US 2008/0126050 A1 May 29, 2008

(51) Int. Cl.
*G06F 17/50* (2006.01)
*G06G 7/48* (2006.01)

(52) U.S. Cl. ..... 703/2; 703/6; 703/8; 166/302; 166/308

(58) Field of Classification Search ..... 703/2, 703/6–8; 166/302–308
See application file for complete search history.

(56) References Cited

U.S. PATENT DOCUMENTS 7,042,802 B2 * 5/2006 Sinha ..... 367/86
2002/0072883 A1 * 6/2002 Lim et al. ..... 703/2
2004/0122640 A1 6/2004 Dusterhoft
2006/0118305 A1 * 6/2006 East et al. ..... 166/308.2
2007/0209799 A1 * 9/2007 Vinegar et al. ..... 166/302

OTHER PUBLICATIONS

P. Macini, et al. Casing Influence While Measuring in Situ Reservoir Compaction—Journal of Petroleum Science & Engineering 50 (2006) 40-54—Bologna, Italy.
PCT International Search Report and Written Opinion—Dated Sep. 16, 2008.

* cited by examiner

*Primary Examiner*—Thai Phan
(74) *Attorney, Agent, or Firm*—Mark E. Scott; Conley Rose, P.C.

(57) ABSTRACT

A method and system of planning hydrocarbon extraction from a hydrocarbon formation. The various methods and systems take a holistic approach to producer well placement and completion, injector well placement and completion, and borehole trajectories to reach the various producer wells and injector wells, the placement and completion selections based on parameters such as initial and expected time-varying stress in the formation, stress in overburden formations, and proximity to faults.

22 Claims, 6 Drawing Sheets

METHOD AND SYSTEM OF PLANNING HYDROCARBON EXTRACTION FROM A HYDROCARBON FORMATION

BACKGROUND

Designing systems for production from underground hydrocarbon reservoirs involves several highly scientific endeavors. For example, prior to drilling, a reservoir engineer uses sophisticated reservoir models to determine parameters such as formation capacity, permeability and fluid flow within the reservoir to determine an optimal number and locations where the a borehole penetrates the formation ("take points"). For each take point identified, further modeling is performed to help identify a proper type of physical interface between the formation and the borehole ("completion"). For example, geo-mechanical modeling may be used to determine stress magnitude and stress orientation in and in close proximity to the formation, and also to determine how pore pressure depletion (caused by hydrocarbon withdrawal) affects the stress magnitude and orientation. Using initial stress information and expected stress changes over time, material modeling may be performed on the rock formation to determine the failure modes and failure envelopes of the formation. Using the modeling results, a completion orientation and type is selected for each particular take point to fit the expected localized physical phenomena, production criteria and possibly financial considerations. From the take point locations and completion determination for each take point, a drilling strategy is devised to provide a borehole to each take point at the lowest possible cost, which translates into selecting a drilling center which provides the shortest possible borehole to each take point.

While the scientific endeavors related to identifying take points and identifying completion types represent a vast improvement over earlier days when drilling strategy and drilling budget were the driving factors in determining the number of boreholes drilled and their placement, further improvements in take point placement and extraction strategy can be made.

SUMMARY

The problems noted above are solved in large part by a method and system of planning hydrocarbon extraction from a hydrocarbon formation. At least some of the illustrative embodiments are methods comprising modeling a hydrocarbon formation under expected production conditions, determining from the model expected time varying stress of the hydrocarbon formation, selecting completion parameters for a take point (the selection taking into account the expected time varying stress), and then selecting a surface-to-take point borehole trajectory for the take point (the surface-to-take point borehole trajectory selected based on prevailing stress direction of a formation through which the surface-to take point borehole is to penetrate), and then drilling from the surface to the take point based the surface-to-take point borehole trajectory.

Other illustrative embodiments are computer-readable mediums storing programs that, when executed by a processor, cause the processor to select completion parameters for a take point of a hydrocarbon formation (the selection of completion parameters taking into account the expected time varying stress in the hydrocarbon formation), and then select a take point-to-surface borehole trajectory for the take point (the take point-to-surface borehole trajectory selected based on prevailing stress direction of a formation through which the take point-to-surface borehole is to penetrate).

Other illustrative embodiments are computer systems comprising a processor, and a memory coupled to the processor. The processor is configured to select completion parameters for a take point of a hydrocarbon formation (the selecting completion parameters taking into account the expected time varying stress in the hydrocarbon formation), and then select a surface-to-take point borehole trajectory for the take point (the surface-to-take point borehole trajectory selected based on prevailing stress direction of a formation through which the surface-to-take point borehole is to penetrate and take point trajectory).

The disclosed devices and methods comprise a combination of features and advantages which enable them to overcome the deficiencies of the prior art devices. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

NOTATION AND NOMENCLATURE

Certain terms are used throughout the following description and claims to refer to particular system components. This document does not intend to distinguish between components that differ in name but not function.

In the following discussion and in the claims, the terms "including" and "comprising" are used in an open-ended fashion, and thus should be interpreted to mean "including, but not limited to . . . ". Also, the term "couple" or "couples" is intended to mean either an indirect or direct connection. Thus, if a first device couples to a second device, that connection may be through a direct connection, or through an indirect connection via other devices and connections.

DETAILED DESCRIPTION OF THE PREFERRED EMBODIMENTS

The various embodiments of the invention are directed to methods and systems for determining take point placement ("producer wells") and injector well placement (e.g., for secondary recovery using water injection), where the determination takes into account reservoir-wide stress and other reservoir characteristics not only at initial placement, but also over the life span of production from the formation. Stated otherwise, the various methods and systems take a holistic approach to producer well placement and completion, as well as a holistic approach to injector well placement and completion, to reduce cost, increase production (over prior placement methods), and/or to ensure financially viable production over the expected life of the field. In order to convey the various ideas addressed in the embodiments of the invention, the specification addresses individual considerations with the understanding that some or all of the individual considerations are considered in the holistic approach. The individual considerations begin with formation stress as it relates to injector well placement.

While all underground hydrocarbon formations are under some form of stress, in some cases the stress does not have a prevailing component or direction. That is, for example, the horizontal compressive stress in the North-South direction felt by a unit volume of hydrocarbon formation may be approximately the same as the horizontal compressive stress in the East-West direction, and the vertical compressive stress may be approximately the same as the horizontal stresses. In yet still other hydrocarbon formations, the stress may have a prevailing component or direction, and thus may exhibit what is termed stress anisotropy. For example, a particular unit volume of hydrocarbon formation may be under a "strike slip" stress tending to shear the unit volume of hydrocarbon formation in a horizontal plane. Formations tend to fracture more easily in the direction of the prevailing stress, and in accordance with some embodiments stress is taken into consideration when deciding injector well placement.

Figure 1:
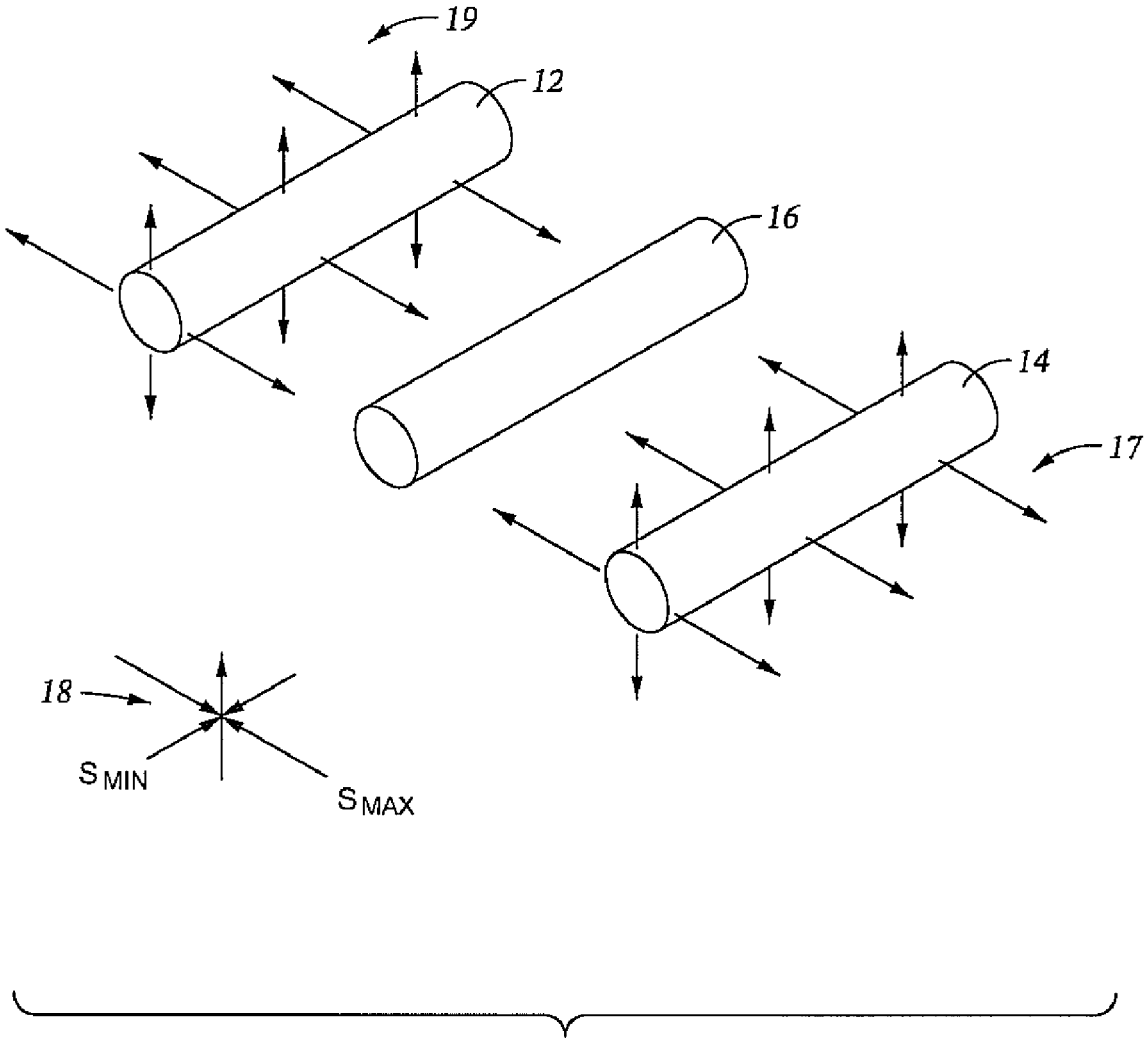
FIG. 1 shows an injector well and producer well relative placement to illustrate the shortcomings of not taking the prevailing stress direction into account when planning relative placement of injector wells and producer wells.

FIG. 1 shows an injector well and producer well relative placement to illustrate the shortcomings of not taking the prevailing stress direction into account when planning relative placement of injector wells and producer wells. In particular, FIG. 1 illustrates three boreholes in a hydrocarbon formation: two injector well boreholes 12 and 14; and a producer well borehole 16. In the illustrative of FIG. 1, all three boreholes reside in the same horizontal plane. The prevailing stress direction in this illustration is parallel to the horizontal plane, as shown by the coordinates 18 (Smax being the direction of prevailing stress, and 5 min being the direction of non-prevailing stress). As water under high pressure is injected into each injector well borehole 12 and 14 in the situation of FIG. 1, the formation tends to fracture along the horizontal plane. In other words and in relevant part, the formation tends to fracture in the direction of the producer well borehole 16. Fracture of a formation increases the permeability in the direction of the fracture, and thus the physical distance of the water sweep towards the producer well borehole 16 from each of the injector well boreholes 12 and 14 will be greater than the physical distance of the water sweep perpendicular to the horizontal plane, as illustrated by arrows 17 and 19. Thus, earlier water breakthrough at the producer well is likely.

Figure 2:
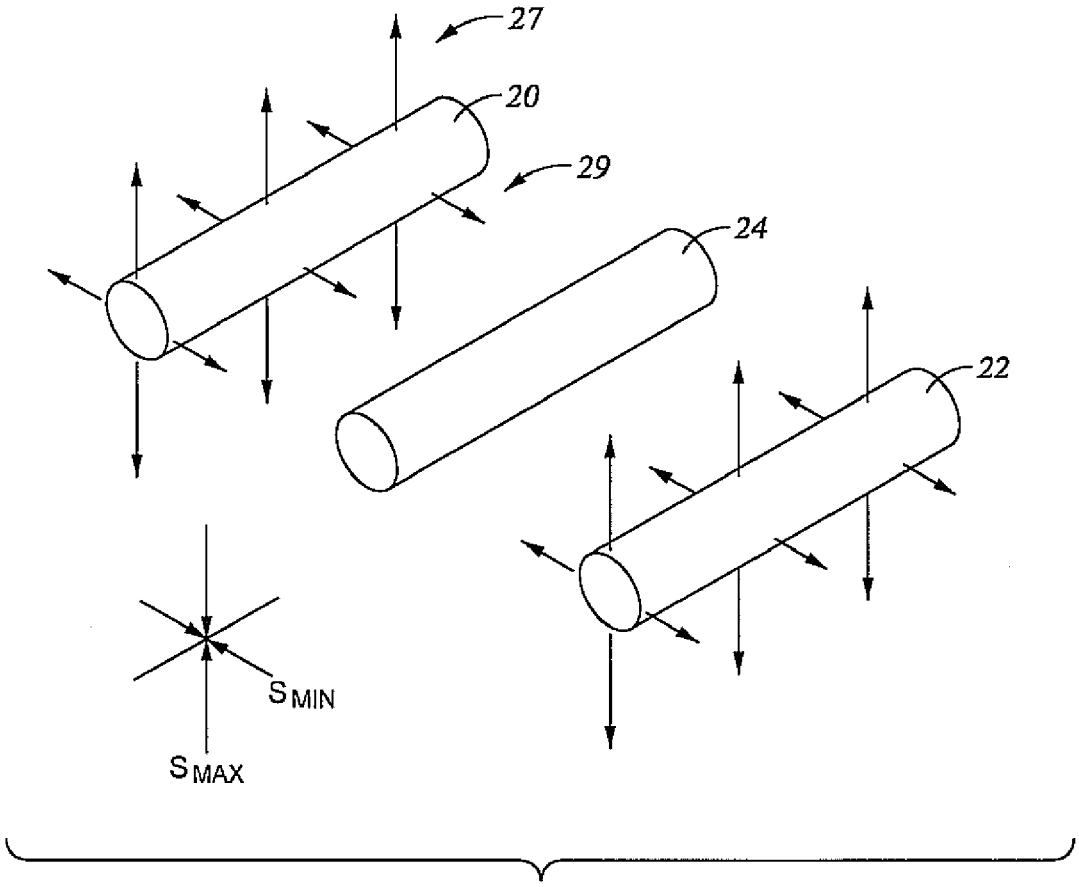
FIG. 2 shows an injector well and producer well placement in accordance with embodiments of the invention.

FIG. 2 illustrates an injector well and producer well placement in accordance with embodiments of the invention where relative placement takes into account the prevailing stress direction. In particular, FIG. 2 illustrates three boreholes in a hydrocarbon formation: two injector well boreholes 20 and 22; and a producer well borehole 24. In the illustration FIG. 2, all three boreholes reside in the same horizontal plane; however, the prevailing stress direction in this illustration is perpendicular to the horizontal plane, as shown by the coordinates 26. As water under high pressure is injected into each injector well boreholes 20 and 22, the formation tends to fracture perpendicularly to the horizontal plane. In other words, the formation tends to fracture perpendicular to the direction of the producer well borehole 24. Fracture increases the permeability in the direction of the fracture, and thus the physical distance of the water sweep outward from each of the injector well boreholes 20 and 22 will be greater than the physical distance of the water sweep toward the producer well, as illustrated by arrows 27 and 29. Thus, water breakthrough at the producer well is less likely (for the same center-to-center spacing of FIG. 1), and the water sweep toward the producer well borehole 24 has a greater vertical spread. Thus, the "sweeping" action of the secondary recovery using water injection is more efficient and the chance of water breakthrough is less likely because the fracture direction is perpendicular to the plane where the injector and producer boreholes reside.

In the illustrations of FIGS. 1 and 2, the prevailing stress direction is horizontal and vertical; however, horizontal and vertical prevailing stress directions are merely illustrative. The prevailing stress direction may be in any orientation, and thus one should not assume that having producer and injector wells in a horizontal plane is always the proper orientation. Having the producer and injector wells in the same horizontal plane would be the proper orientation if the prevailing stress direction was vertical. More generally still, and in accordance with embodiments of the invention, as for injector wells and producer wells residing in the same plane, the prevailing stress direction of the formation should be substantially perpendicular to the plane. The specification now turns to considerations relating to faults.

Underground faults may be tectonic in nature (e.g., the San Andreas fault that runs substantially through California), or the underground faults may be more localized. Regardless of scale, a fault represents and actual or potential geologic instability. Localized faults within or proximate to a hydrocarbon reservoir are in most cases inactive so long as there are no major physical changes to surrounding formations. However, in the presence of physical changes (e.g., reduced pressure on either side of the fault caused by hydrocarbon removal, an attempt to perform secondary recovery in the form of water injection where the water is forced across the fault), the localized fault may become active. Thus, the various embodiments of the invention take into account faults proximate to or within a hydrocarbon formation when determining the locations of producer wells and injector wells. For example, no portion of a borehole (whether for a producer well or injector well) should cross a localized fault, especially if various modeling (e.g., reservoir modeling, geo-mechanical modeling and/or material modeling) indicates fault movement is probable over the production life of the reservoir. Moreover, injector well placement relative to producer well placement in accordance with some embodiments takes into account localized faults. In particular, in order to avoid instability associated with the localized faults, in accordance with some embodiments injectors wells are positioned such that no faults exist between the injector wells and the one or more production wells toward which the injector well sweeps. Yet further still, the localized faults in a hydrocarbon formation may produce wildly varying stress regimes, and in accordance with embodiments of the invention the relative placement of producer wells and injector wells may vary over the formation. For example, in one portion of the formation the injector wells may be physically above and below the producer wells toward which they sweep, yet in another portion of the formation the injector wells may reside within the same horizontal plane, all a function of stress in the formation caused by geologic shifts at the localized faults.

Summarizing before continuing, producer well and injector well placement in accordance with embodiments of the invention takes into account not only the reservoir characteristics which dictate the best take point, but also takes into account the initial and time varying stress regime in the formation as well as local fault considerations.

The specification now turns to considerations of completions. A completion is the physical interface between the borehole and the formation. Completions take many forms. For example, when formation properties allow, the completion may be merely the borehole itself (no casing or liner). In other situations, the completion may be a slotted casing to allow hydrocarbon flow into the casing, but with the casing still providing some structural support. In yet still other situations, a casing may be present with the casing perforated in particular directions in an attempt to increase hydrocarbon production from particular directions. In other situations, the completion may be a gravel pack at the terminal end of the borehole. In situations where initial or future permeability of the formation is a concern, the completion may involve hydraulic fracturing of the formation surrounding the borehole, and in some case hydraulic insertion of a "propant" into the formation to help ensure continued permeability in spite of formation compaction. All these variations for completions may be applied in vertically oriented boreholes, high angle boreholes, or horizontal boreholes as the particular situation dictates. Copending and commonly assigned U.S. Patent Application Publication No. 2004/0122640, titled, "System and process for optimal selection of hydrocarbon completion type and design," now U.S. Pat. No. 7,181,380, incorporated by reference herein as if reproduced in full below, discusses completion selection for producer wells, including considerations such as probable failure mechanisms (e.g., reservoir compaction, shear failure, fault re-activation and multi-phase hydrocarbon flow) and completion requirements (e.g., sand exclusion, sand avoidance, and deferred sand management). Stated otherwise, the aforementioned patent discusses considerations for choosing an optimum orientation and deviation (which together may be referred to as trajectory and/or direction), as well as choosing an optimum completion type for a producer well.

In accordance with at least some embodiments, in addition to making decisions regarding completion types for producer wells, similar decisions are made for the injector wells. In the related art failure mechanisms are not taken into account when choosing completion types for injector wells, and thus in most instances the least expensive completion is selected. Thus, in accordance with some embodiments the potential failure mechanism for producer wells that one may attempt to address based on the completion type also affect injector wells. Moreover, in accordance with some embodiments the secondary considerations of sand management are also taken into account. In the case of an injector well, however the sand management concern is not production of sand, but rather formation plugging and reduced formation permeability caused by sand and other "fines" (fine grain materials). If the injector well completion does not reduce or eliminate sand and fine production, the water injection through the injector well carries the sand and fines into the formation, which lodges and reduces permeability. The reduced permeability thus reduces the injected water's ability to migrate within the formation, and adversely affects sweep capability of the injector well. Thus, in accordance with embodiments of the invention one or more of the various models (e.g., reservoir model, geo-mechanical model, and material model), and the criteria discussed above, are used to select the location, orientation, deviation and completion type for the injector wells which provide the lowest risk and highest return on investment for the overall reservoir over the life of the reservoir.

Having now discussed the holistic approach to producer well and injector well placement, taking into consideration formation stress, faulting and completion considerations, attention now turns to drilling considerations. In the related art, take points are determined, and the driller then determines the most cost effective plan to get boreholes from the surface to each of the take points. The most cost effective plan is, in most cases, selecting drill center (centered over the formation), and drilling boreholes to each take point. Thus, in the related art the boreholes are engineered from the surface to the take point. However, stress of the hydrocarbon formations, as well as formations above the hydrocarbon formation ("overburden"), affect drilling risk as a function of drilling direction in relation to prevailing stress direction. In particular, the risk of borehole cave-in and substantial wall sloughing increases as the direction of drilling approaches the prevailing stress direction.

Figure 3:
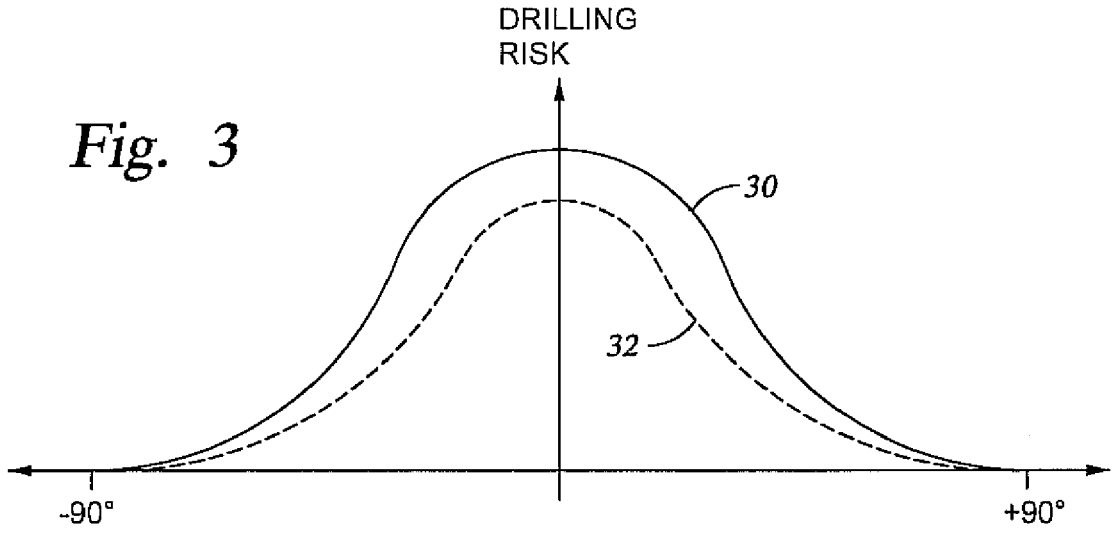
FIG. 3 shows a plot of drilling risk as a function of angle of the drilling direction relative to the prevailing stress direction.

FIG. 3 illustrates a plot of drilling risk 30 as a function of angle of the drilling direction relative to the prevailing stress direction (with drilling fluid weight, and therefore downhole pressure, held constant). At the origin (zero degrees or the drilling direction perfectly aligned with the prevailing stress direction), the drilling risk of stress-induced borehole failures is at a maximum. As the direction changes relative to the prevailing stress, the drilling risk of stress-induced borehole failures also drops, with the minimum risk of stress-induced borehole failure occurring when the drilling direction is perpendicular to the prevailing stress direction. The illustration of FIG. 3 assumes a two-dimension stress regime for purposes of simplified explanation. However, the idea of FIG. 3 scales to three-dimensional space, with drilling risk of stress-induced borehole failure being at a maximum in the three-dimensional prevailing stress direction. The discussion relative to FIG. 3 also assumes a constant drilling fluid weight; however, the risk of stress-induced borehole failures may also be tempered by increased drilling fluid weight (and therefore higher downhole pressure pushing against the walls). FIG. 3 shows the relationship between risk and drilling fluid weight by dashed line 32. In particular, dashed line 32 illustrates the stress related risk with an increased drilling fluid weight.

Figure 4:
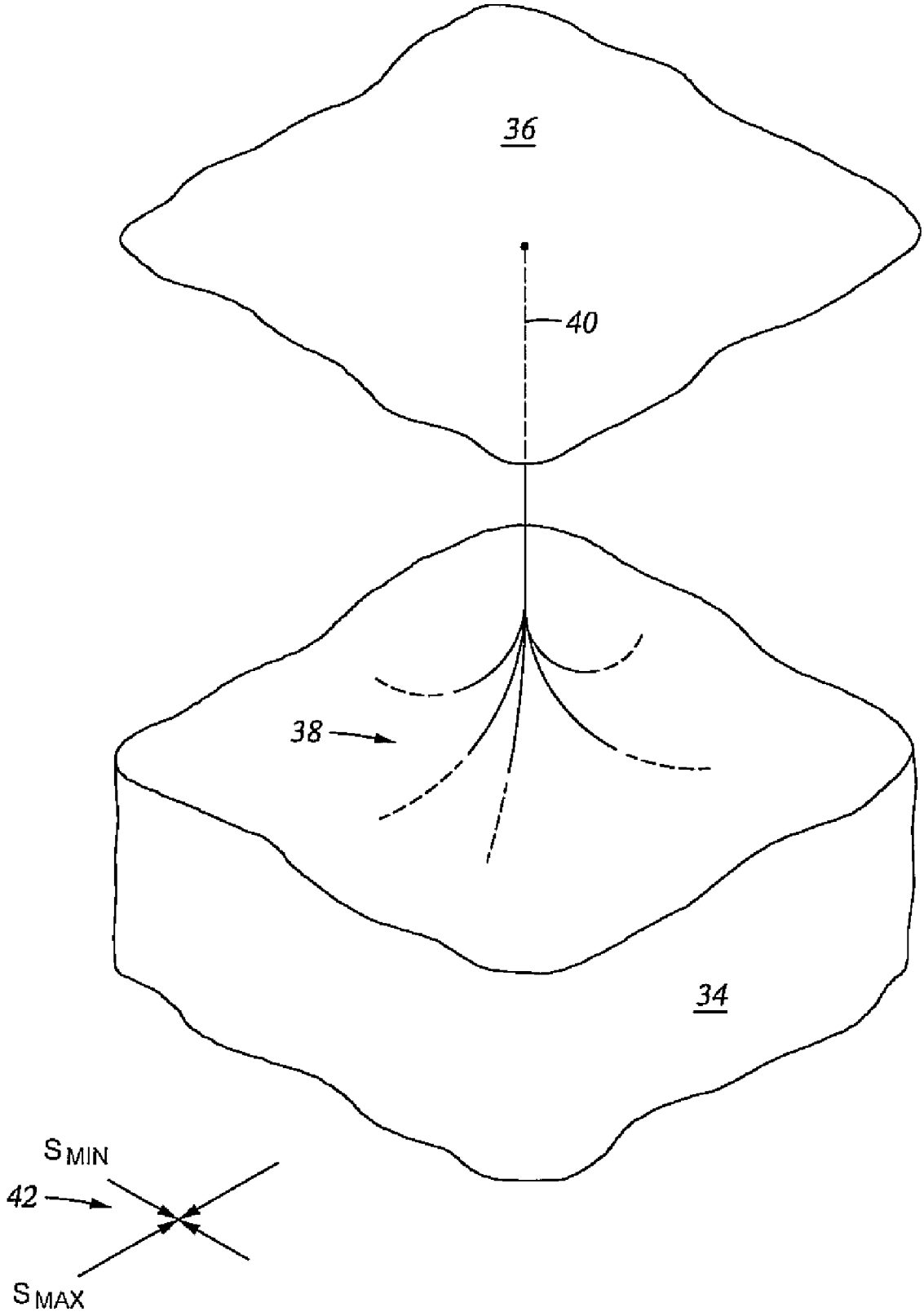
FIG. 4 shows a hydrocarbon producing formation below a surface, and how the boreholes are drilled in accordance when not taking into account stress.

Now, taking into consideration the drilling risk as a function of prevailing stress direction, consider FIG. 4 which illustrates a hydrocarbon formation 34 below a surface 36, and which also illustrates how the boreholes are drilled in accordance with the related-art. A plurality of lateral boreholes 38 extend into the formation 34 at the pre-selected take points, and/or injection-points all branching from a single vertical borehole 40 centered above the formation 34. Further consider that in the illustrative situation of FIG. 4 the prevailing stress in the overburden formations (not specifically shown) is as illustrated by the coordinates 42. Thus, the risk associated with the plurality of lateral boreholes 38 is higher, in some cases significantly higher, because of the historical momentum of placing the single vertical borehole 40 centered over the formation and drilling toward each take point and/or injection point. Moreover, selecting borehole trajectory in this manner does not take into account the optimum completion orientations, as discussed above.

In accordance with at least some embodiments of the invention, the boreholes to reach the take points and the injection points are engineered starting at the respective take points and injection points, with the engineering/route selection taking into account the preferred orientation of the completions as well as the prevailing stress in the overburden formation. Engineering boreholes and/or selecting routes for the boreholes in this manner dictates that in situations where the overburden formation has a prevailing stress direction, the drilling center may not correspond to the physical center of the formation. Rather, the drilling center may be shifted in the direction of the non-prevailing stress. While such a shift shortens some boreholes, it lengthens other boreholes; however, the drilling risk associate with substantially every borehole may be lowered because of the drilling direction relative to the direction of prevailing stress in the formations.

Figure 5:
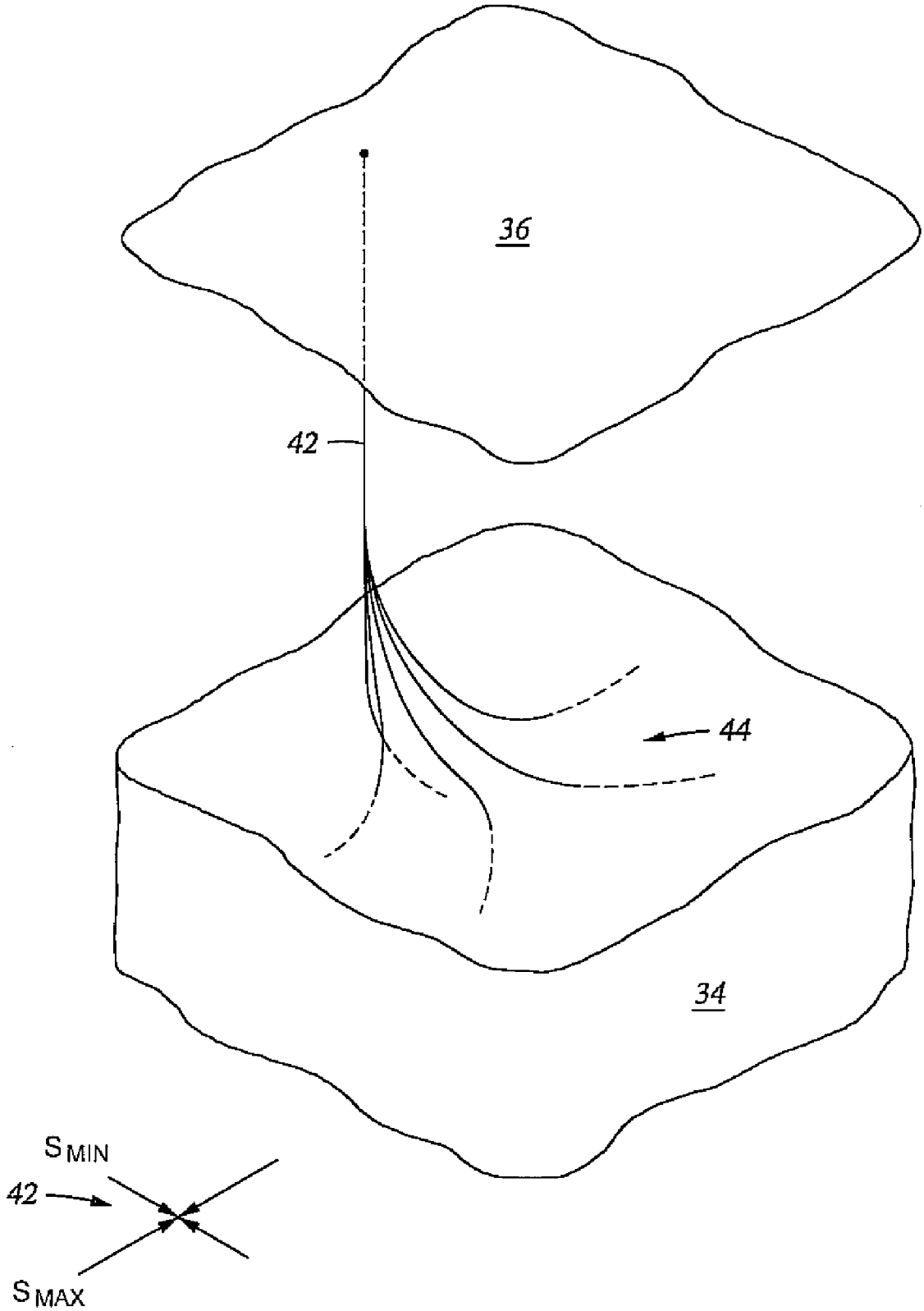
FIG. 5 shows take points and/or injection points in the formation as in FIG. 4, but with borehole trajectories for the take points and/or injection points selected in accordance with some embodiments.

FIG. 5 illustrates takes points and/or injection points in the formation as in FIG. 41 but in this case (and applying the various embodiments of the invention) the vertical borehole 42 is shifted in the non-prevailing stress direction, such that, as a whole, the lateral boreholes are drilled in such a manner as to reduce the risk of stress-induced borehole failure. FIG. 5 also illustrates that a preferred drilling direction (perpendicular to the prevailing stress), may not be the preferred completion orientation, and thus some drilling in a non-preferred direction is to be tolerated to accommodate particular completion orientations determined prior to drilling. Using this methodology, however, the length of the boreholes drilled in the higher risk direction is reduced over the "spider web" approach of the related art, and the risk of drilling in the higher risk directions may be mitigated by careful control of drilling fluid weight, as discussed above.

Figure 6:
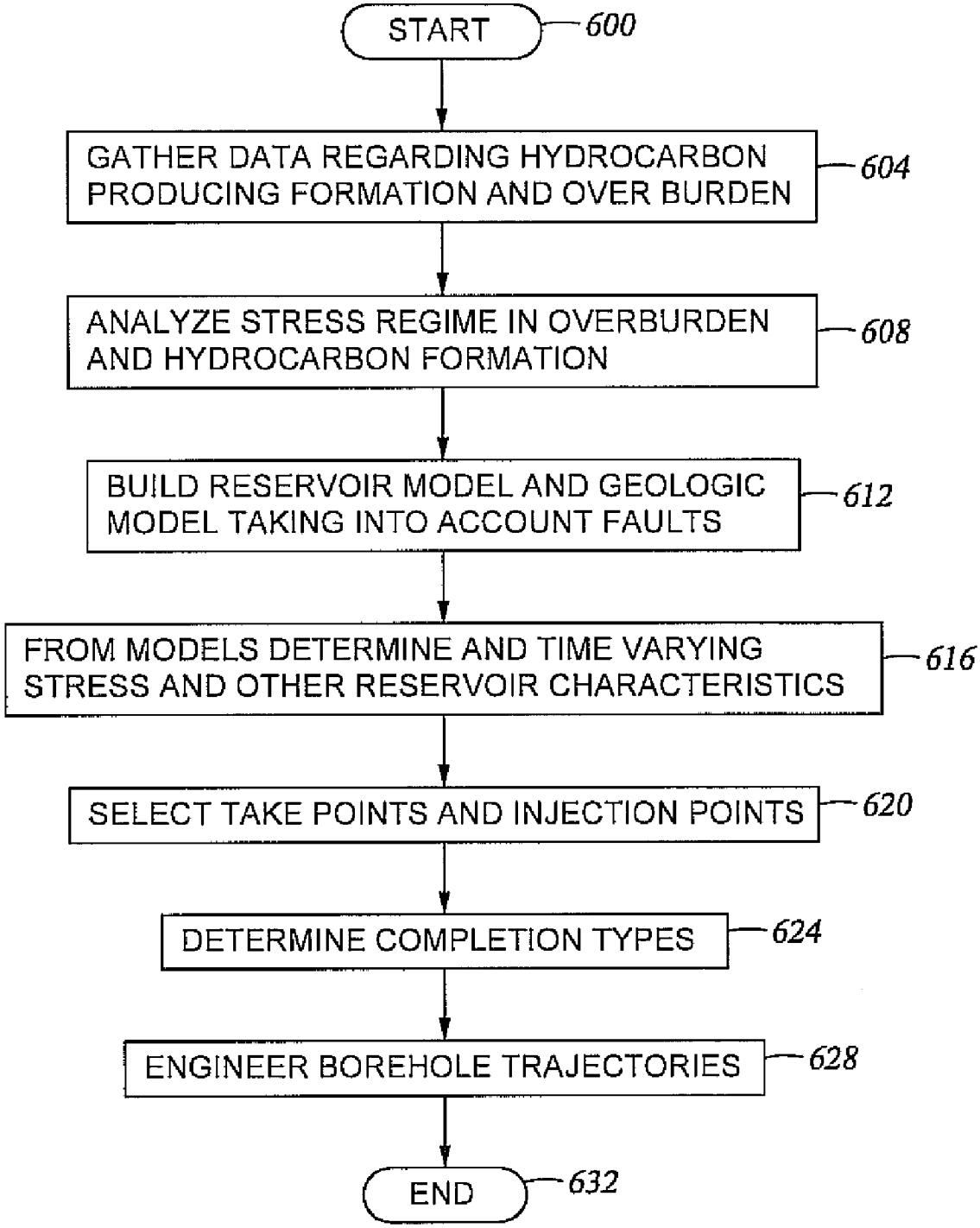
FIG. 6 shows a method in accordance with some embodiments.

FIG. 6 illustrates a method in accordance with embodiments of the invention. In particular, FIG. 6 illustrates a method that ties together the individual considerations discussed above. The method starts (block 600) and moves to gathering data regarding a hydrocarbon formation and overburden formations (block 604). In situations where the hydrocarbon formation under scrutiny is a formation from which hydrocarbons have never been produced, the data gather may be from seismic data, or data regarding nearby formations that are believed to be of similar character. In other embodiments, a test or exploration well may be drilled into the hydrocarbon formation, and data may be gathered using logging while drilling, measuring while drilling, wireline tools, core samples, and the like. The data gathered may be data such as formation and overburden stress regimes, the presence and proximity of faults, formation porosity, rock strength and permeability. In yet still other embodiments, the method may be applied to an aging hydrocarbon formation whose production has fallen, and thus data of type discussed above may be readily available.

Regardless of how the data regarding the formation and overburden is gathered, the stress regime in the hydrocarbon formation and overburden is analyzed (block 608), and based at least in part on the analysis reservoir models and/or a geological models are built, with the models taking into account the initial stress regime and local and non-local faulting (block 612). From the one or more models, the time varying stress that can be expect to occur in the hydrocarbon formation is determined (block 616), possibly along with other reservoir characteristics (e.g., hydrocarbon capacity, expected production flow rate).

Based on the models and the time varying stress predictions, the take points and injection points (if any) are selected (block 620). Take points are selected based on the models to achieve the most voluminous production and/or most efficient hydrocarbon removal from the hydrocarbon formation. Relatedly, injection points for secondary recovery (even if the actual wells are not drilled to later in the life of the field (e.g., years three to five)) are selected to achieve one or more of the most voluminous production and/or the most efficient hydrocarbon removal.

Still referring to FIG. 6, once the take points and injection points are determined, the orientation, deviation and completion type for each take point and each injection point is determined (block 624). Copending and commonly assigned patent titled "System and process for optimal selection of hydrocarbon completion type and design," discusses in detail the determination regarding orientation, deviation and completion type for take points. Moreover, in accordance with embodiments of the invention, the same orientation, deviation and completion type determination is made with respect to injection points for secondary recovery. Other considerations that affect injection point placement are considered as well, such as the direction of the prevailing stress, and location of local faulting.

Finally, once the take points and injection points are determined, and the orientation, and deviation are determined, the various borehole trajectories to reach the take points and injection points are engineered (block 628), taking into account stress in the formation and overburden, including placing the central borehole (if used) at a position off-center from the center of formation. Thereafter, the process ends (block 632). The illustration of FIG. 6 appears as a single iteration; however, in situations where only partial data is used to make the various decisions of the method (e.g., where no exploratory well is drilled), as new and/or better data becomes available (e.g., during the drilling process), the method may be re-entered and previous decisions re-evaluated and changed based on the new and/or better data.

Figure 7:
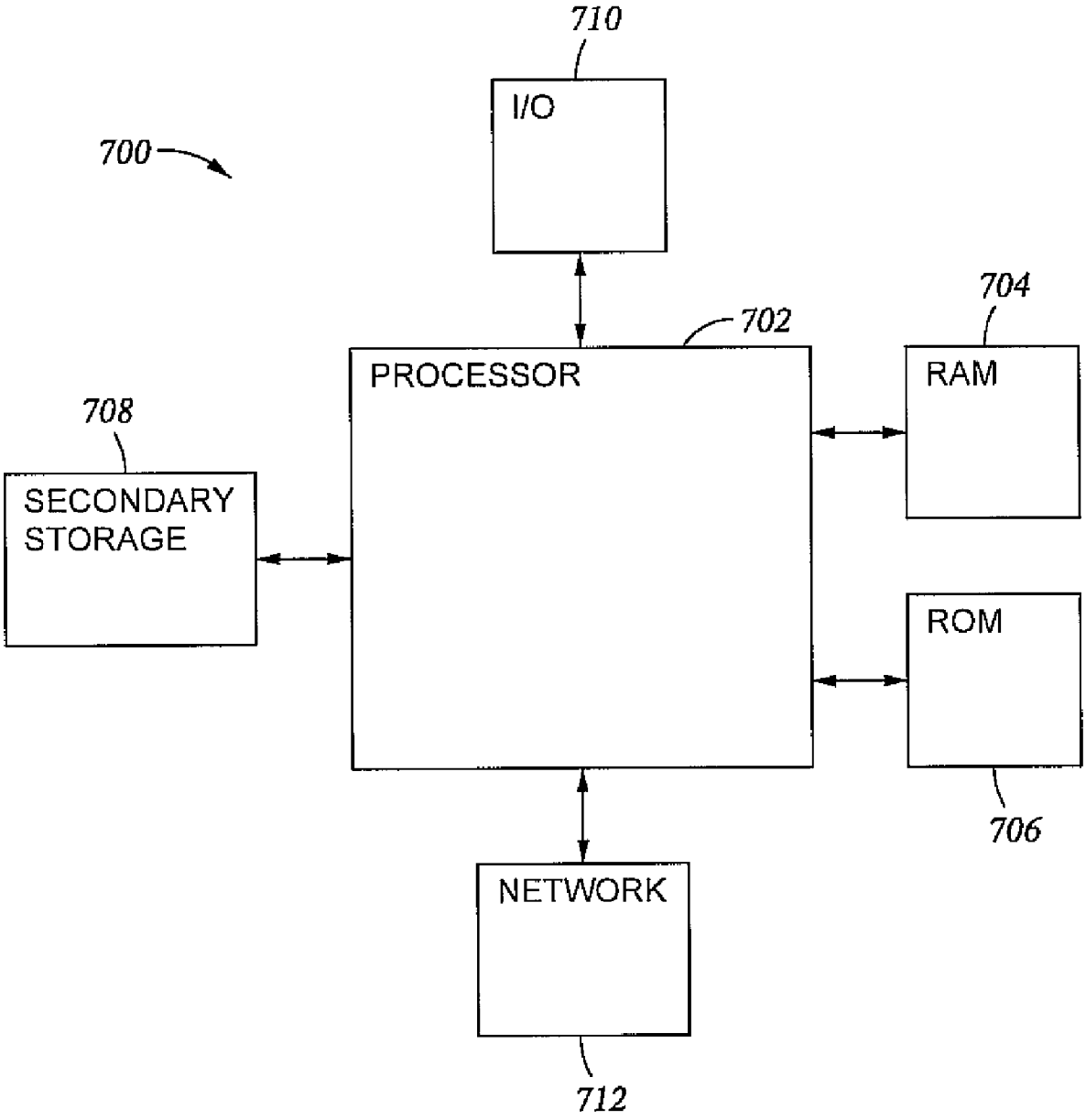
FIG. 7 shows a computer system in accordance with some embodiments.

A process for selecting well completion and design as described herein may be implemented in whole or in part on a variety of different computer systems. FIG. 7 illustrates a computer system suitable for implementing the various embodiments of the present invention. The computer system 700 comprises a processor 702 (also referred to as a central processing units, or CPU) that is coupled to memory devices such as primary storage devices 704 (e.g., a random access memory, or RAM) and primary storage devices 706 (e.g., a read only memory, or ROM).

ROM acts to transfer data and instructions uni-directionally to the processor 702, while RAM is used to transfer data and instructions in a bi-directional manner. Both RAM 704 and ROM 706 may be considered computer-readable media. A secondary storage medium 708 (e.g., mass memory device) is also coupled bi-directionally to processor 702 and provides additional data storage capacity. The mass memory device 708 may also be considered a computer-readable medium that may be used to store programs and data. Mass memory device 708 may be a storage medium such as a non-volatile memory (e.g., hard disk or a tape) which is in most cases has slower access times than RAM 704 and ROM 706. A specific primary storage device 708 such as a CD-ROM may also pass data uni-directionally to the processor 702.

Processor 702 is also coupled to one or more input/output devices 710 (e.g., video monitors, track balls, mice, keyboards, microphones, touch-sensitive displays, transducer card readers, magnetic or paper tape readers, tablets, styluses, voice or handwriting recognizers, or other computers). Finally, processor may also coupled to a computer or telecommunications network using a network connection 712. With network connection 712, it is contemplated that processor may receive information from the network, or might output information to the network in the course of performing the process in accordance with the various embodiments. Such information, which is often represented as a sequence of instructions to be executed by processor 702, may be received from and outputted to the network, for example, in the form of a computer data signal embodied in a carrier wave.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A method comprising:

modeling a hydrocarbon formation under expected production conditions;

determining from the model expected time varying stress of the hydrocarbon formation;

selecting completion parameters for a take point, the selecting taking into account the expected time varying stress; and then selecting a surface-to-take point borehole trajectory for the take point, the surface-to-take point borehole trajectory selected based on prevailing stress direction of a formation through which the surface-to take point borehole is to penetrate; and then drilling from the surface to the take point based the surface-to-take point borehole trajectory.

2. The method as defined in claim 1 further comprising:

selecting completion parameters for one or more injection points; and then selecting an surface-to-injection point borehole trajectory for the one or more injection points, the surface-to-injection point borehole trajectory selected based on prevailing stress direction of a formation through the surface-to-injection point borehole is to penetrate; and then drilling from the surface to the one or more injection points based on the surface-to-injection point borehole trajectory.

3. The method as defined in claim 2 wherein selecting completion parameters further comprises:

selecting a trajectory for the take point based on a prevailing stress direction in the hydrocarbon formation; and selecting a trajectory for the one or more injection points based on a prevailing stress direction in the hydrocarbon formation;

wherein the take point trajectory and the one more injection point trajectories reside in a plane, and wherein the plane is substantially perpendicular to the prevailing stress direction.

4. The method as defined in claim 2 wherein selecting completion parameters for the one or more injection points further comprises selecting one or more from the group consisting of orientation, deviation and completion type.

5. The method as defined in claim 1 wherein selecting the surface-to-take point borehole trajectory further comprises selecting a drill center shifted from a horizontal center of the hydrocarbon formation, the shifting in the direction of the non-prevailing stress of a formation through which the surface-to-take point borehole is to penetrate.

6. The method as defined in claim 1 further comprising:

selecting a location for the take point based on proximity of faults in, and proximity of faults to, the hydrocarbon formation; and selecting locations for the one or more injection points based on proximity of faults in, and proximity of faults to, the hydrocarbon formation;

wherein the take point and the one or more injection points are selected such that a water sweep from the one or more injection points toward the take point does not cross a fault.

7. The method as defined in claim 1 further comprising:

selecting a location for the take point based on proximity of faults in, and proximity of faults to, the hydrocarbon formation; and selecting locations for the one or more injection points based on proximity of faults in, and proximity of faults to, the hydrocarbon formation;

wherein the take point and the one or more injection points are selected such that a water sweep from the one or more injection points toward the take point does substantially activate or re-activate a fault.

8. The method as defined in claim 1 wherein selecting completion parameters for the take points further comprises selecting one or more from the group consisting of: orientation, deviation and completion type.

9. A computer-readable medium storing a program that, when executed by a processor, causes the processor to:

select completion parameters for a take point of a hydrocarbon formation, the selection of completion parameters taking into account the expected time varying stress in the hydrocarbon formation; and then select a take point-to-surface borehole trajectory for the take point, the take point-to-surface borehole trajectory selected based on prevailing stress direction of a formation through which the take point-to-surface borehole is to penetrate.

10. The computer-readable medium as defined in claim 9 wherein the program further causes the processor to:

model the hydrocarbon formation under expected production conditions; and determine from the model expected time varying stress of the hydrocarbon formation.

11. The computer-readable medium as defined in claim 9 wherein the program further causes the processor to:

select completion parameters for one or more injection points; and then select an injection point-to-surface borehole trajectory for the one or more injection points, the injection point borehole trajectory selected based on prevailing stress direction of a formation through the injection point-to-surface borehole is to penetrate.

12. The computer-readable medium as defined in claim 11 wherein when the processor selects completion parameters the program causes the processor to:

select a trajectory for the take point based on a prevailing stress direction in the hydrocarbon formation; and select a trajectory for the one or more injection points to reside in a plane with the direction of the take point, and wherein the plane is substantially perpendicular to the prevailing stress direction.

13. The computer-readable medium as defined in claim 11 wherein when the processor selects completion parameters for the one or more injection points the program causes the processor to select one or more from the group consisting of: orientation, deviation and completion type.

14. The computer-readable medium as defined in claim 9 wherein when the processor selects the take point-to-surface borehole trajectory the program causes the processor to select a drill center shifted from a horizontal center of the hydrocarbon formation, the shift in the direction of the non-prevailing stress of a formation through which the take point-to-surface borehole is to penetrate.

15. The computer-readable medium as defined in claim 9 wherein the program further causes the processor to:

select a location for the take point based on proximity of faults in, and proximity of faults to, the hydrocarbon formation; and select locations for the one or more injection points based on proximity of faults in, and proximity of faults to, the hydrocarbon formation;

wherein the take point and the one or more injection points are selected such that a water sweep from the one or more injection points toward the take point does not cross a fault.

16. The computer-readable medium as defined in claim 9 wherein the program further causes the processor to:

select a location for the take point based on proximity of faults in, and proximity of faults to, the hydrocarbon formation; and select locations for the one or more injection points based on proximity of faults in, and proximity of faults to, the hydrocarbon formation;

wherein the take point and the one or more injection points are selected such that a water sweep from the one or more injection points toward the take point does not activate or re-activate a fault.

17. The computer-readable medium as defined in claim 9 wherein when the processor selects completion parameters for the take points the program causes the processor to select one or more from the group consisting of: orientation, deviation and completion type.

18. A computer system comprising:

a processor;

a memory coupled to the processor;

wherein the processor is configured to:

select completion parameters for a take point of a hydrocarbon formation, the selecting completion parameters taking into account the expected time varying stress in the hydrocarbon formation; and then select a surface-to-take point borehole trajectory for the take point, the surface-to-take point borehole trajectory selected based on prevailing stress direction of a formation through which the surface-to-take point borehole is to penetrate and take point trajectory.

19. The computer system as defined in claim 18 wherein processor is further configured to:

select completion parameters for one or more injection points; and then select an surface-to-injection point borehole trajectory for the one or more injection points, the surface-to-injection point borehole trajectory selected based on prevailing stress direction of a formation through the surface-to-injection point borehole is to penetrate and injection point trajectory.

20. The computer system as defined in claim 19 wherein when selecting completion parameters the processor is further configured to:

select a heading for the take point based on a prevailing stress direction in the hydrocarbon formation; and select a heading for the one or more injection points to reside in a plane with the heading of the take point, and wherein the plane is substantially perpendicular to the prevailing stress direction in the hydrocarbon formation.

21. The computer system as defined in claim 18 wherein the processor is further configured to:

select a location for the take point based on proximity of faults in, and proximity of faults to, the hydrocarbon formation; and select locations for the one or more injection points based on proximity of faults in, and proximity of faults to, the hydrocarbon formation;

wherein the take point and the one or more injection points are selected such that a water sweep from the one or more injection points toward the take point does not cross a fault.

22. The computer system as defined in claim 18 wherein the method further comprises:

select a location for the take point based on proximity of faults in, and proximity of faults to, the hydrocarbon formation; and select locations for the one or more injection points based on proximity of faults in, and proximity of faults to, the hydrocarbon formation;

wherein the take point and the one or more injection points are selected such that a water sweep from the one or more injection points toward the take point does not activate or re-activate a fault.

* * * * *